US010876486B2

(12) United States Patent
Kogo

(10) Patent No.: US 10,876,486 B2
(45) Date of Patent: Dec. 29, 2020

(54) FUEL INJECTION CONTROL DEVICE

(71) Applicant: DENSO CORPORATION, Kariya (JP)

(72) Inventor: Kazuya Kogo, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/681,999

(22) Filed: Nov. 13, 2019

(65) Prior Publication Data

US 2020/0080507 A1 Mar. 12, 2020

Related U.S. Application Data

(63) Continuation of application No. PCT/JP2018/018996, filed on May 16, 2018.

(30) Foreign Application Priority Data

May 19, 2017 (JP) ..... 2017-099752

(51) Int. Cl.

| | |
|---|---|
| ***F02D 41/20*** | (2006.01) |
| ***F02P 5/145*** | (2006.01) |
| ***F02M 51/06*** | (2006.01) |
| ***F02D 41/34*** | (2006.01) |

(52) U.S. Cl.

CPC ..... *F02D 41/20* (2013.01); *F02D 41/345* (2013.01); *F02M 51/06* (2013.01); *F02P 5/145* (2013.01); *F02D 2041/2051* (2013.01); *F02D 2041/2082* (2013.01)

(58) Field of Classification Search

CPC ..... F02D 41/20; F02D 41/345; F02D 2041/2051; F02D 2041/2082; F02P 5/145

USPC ..... 123/478, 495

See application file for complete search history.

(56) References Cited

U.S. PATENT DOCUMENTS

| | | | | |
|---|---|---|---|---|
| 2015/0377176 | A1 | 12/2015 | Hatanaka et al. | |
| 2017/0051696 | A1* | 2/2017 | Mukaihara | F02D 41/20 |
| 2019/0211767 | A1* | 7/2019 | Miyake | F02M 51/00 |
| 2020/0088122 | A1* | 3/2020 | Kusakabe | F02D 41/402 |

* cited by examiner

*Primary Examiner* — Mahmoud Gimie

(74) *Attorney, Agent, or Firm* — Nixon & Vanderhye PC

(57) ABSTRACT

A fuel injection control device first causes a first power supply unit to apply a voltage to a fuel injection valve, subsequently causes a second power supply unit to apply a voltage to the fuel injection valve, and after the first power supply unit applies the voltage, executes a lift position determination process to determine that a valve element of the fuel injection valve reaches a predetermined lift position based on a change in a drive current. A first control unit performs a drive control on the fuel injection valve without executing the lift position determination process. A second control unit executes the lift position determination process and performs a drive control on the fuel injection valve. The second control unit controls the drive current to decrease when the valve element reaches the predetermined lift position compared to a case where the first control unit performs drive control.

13 Claims, 9 Drawing Sheets

FUEL INJECTION CONTROL DEVICE

CROSS REFERENCE TO RELATED APPLICATION

The present application is a continuation application of International Patent Application No. PCT/JP2018/018996 filed on May 16, 2018, which designated the U.S. and claims the benefit of priority from Japanese Patent Application No. 2017-99752 filed on May 19, 2017. The entire disclosures of all of the above applications are incorporated herein by reference.

TECHNICAL FIELD

The present disclosure relates to a fuel injection control device for an internal combustion engine.

BACKGROUND

Conventionally, a fuel injection valve is mounted to an internal combustion engine of a vehicle to inject fuel in each cylinder of the engine. A sort of a fuel injection valve includes a solenoid actuator.

SUMMARY

According to one aspect of the present disclosure, a fuel injection system includes a power supply unit and a fuel injection valve. A fuel injection control device is configured to cause the power supply unit to apply a voltage to the fuel injection valve.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
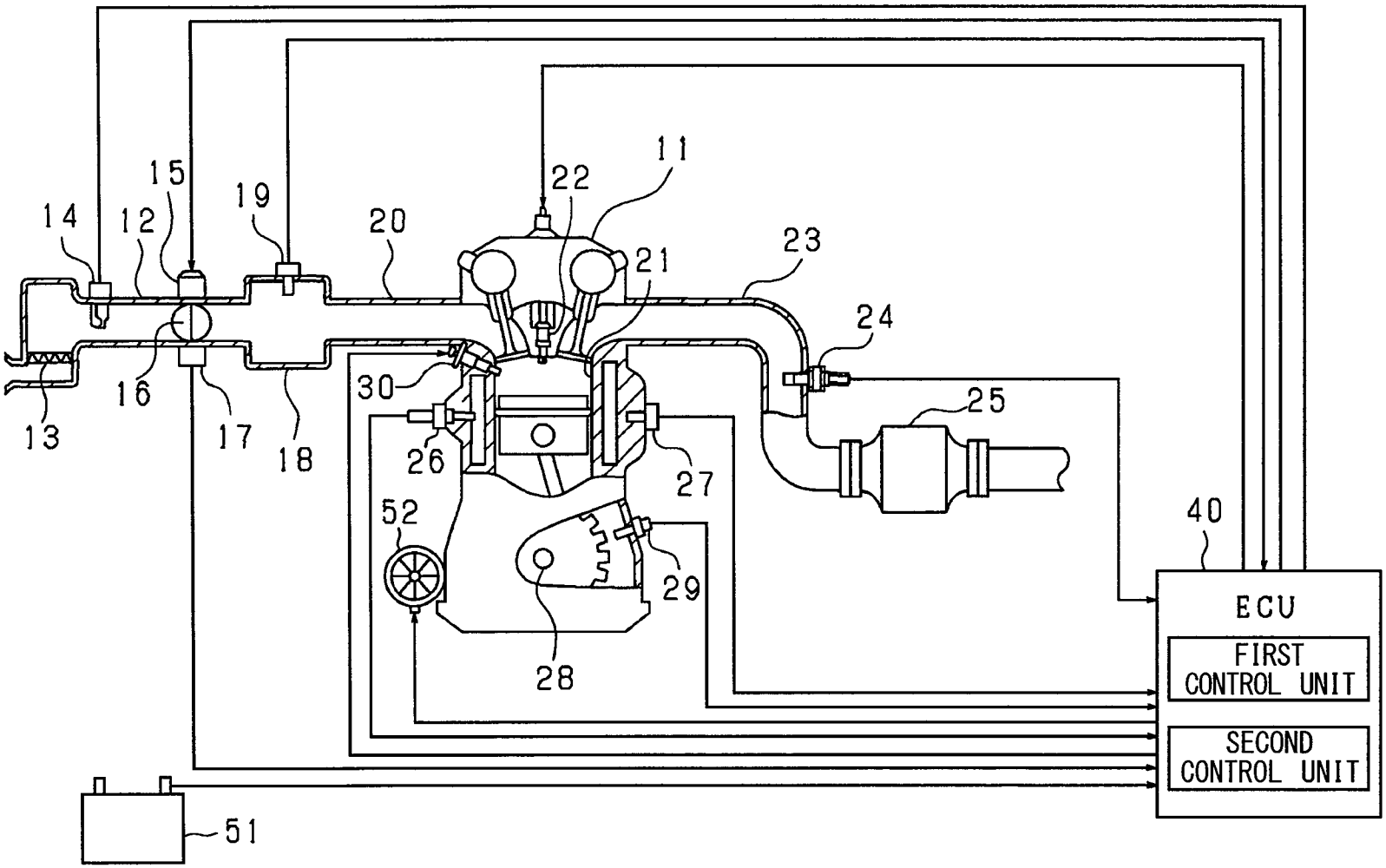
FIG. 1 is a diagram illustrating a schematic configuration of an engine control system.

Hereinafter, an example of the present embodiment will be described.

A fuel injection valve according to the example injects fuel to each cylinder of an internal combustion engine mounted on a vehicle. The fuel injection valve includes an electromagnetic solenoid that is driven with an electric power supplied from, for example, an in-vehicle battery. A fuel injection control device controls a duration time of energization on a coil included in the fuel injection valve body to open a valve element (needle) of the fuel injection valve. In this way, the fuel injection control device controls a fuel injection time and a fuel injection quantity.

It is conceivable to take variations in machine difference among fuel injection valves into account to ensure an appropriate injection quantity. In one example, the fuel injection control device may detect a drive current supplied to the fuel injection valve and may determine that the valve element reaches a full-lift position according to the detected drive current. The fuel injection control device may correct the energization time for the fuel injection valve based on the determination result.

In one example, the fuel injection control device may apply a high voltage to the fuel injection valve and subsequently may apply a low voltage to the fuel injection valve thereby to drive the fuel injection valve. In this example, the fuel injection control device may determine that the valve element has reached the full-lift position after applying the low voltage based on a change in the detected drive current. A large change in the drive current could enable determination of the full-lift position with high accuracy. Depending on determination conditions, however, the drive current may not always change sufficiently, and consequently, and the determination may not be made with sufficient accuracy.

According to one example of the present disclosure, a fuel injection control device for a fuel injection system includes a first power supply unit, a second power supply unit configured to apply a power supply voltage lower than that of the first power supply unit, a fuel injection valve configured to be driven by power supplied from each of the first power supply unit and the second power supply unit, and a current detection unit configured to detect a drive current for the fuel injection valve. The fuel injection control device is configured first to cause the first power supply unit to apply a voltage to the fuel injection valve, subsequently to cause the second power supply unit to apply a voltage to the fuel injection valve, and to execute a lift position determination process after the first power supply unit applies the voltage to determine that a valve element of the fuel injection valve reaches a predetermined lift position based on a change in the drive current detected by the current detection unit, when driving the fuel injection valve. The fuel injection control device comprises a first control unit configured to perform a drive control on the fuel injection valve without executing the lift position determination process. The fuel injection control device further comprises a second control unit configured to execute the lift position determination process to perform a drive control on the fuel injection valve. The second control unit is configured to control the drive current for the fuel injection valve such that the drive current when the valve element reaches the predetermined lift position decreases compared to a case where the first control unit performs the drive control.

The fuel injection valve is driven by first causing the first power supply unit to apply a voltage to the fuel injection valve, and subsequently causing the second power supply unit to apply a voltage. At an initial stage of opening the valve, a high voltage is applied to ensure the responsiveness of the fuel injection valve to open. A low voltage is subsequently applied to keep the fuel injection valve open.

The lift position determination process is executed to determine that a valve element of the fuel injection valve reaches a predetermined lift position based on a change in a drive current detected by the current detection unit after the first power supply unit applies the voltage. When executing the lift position determination process, the second control unit controls the drive current for the fuel injection valve such that the drive current when the valve element reaches the predetermined lift position decreases compared to the case where the first control unit performs drive control. When the valve element reaches the predetermined lift position, a decrease in the drive current reverses the direction of the drive current gradient before and after reaching the predetermined lift position. The gradient is likely to change steeply. When the lift position determination process is to be executed, the decrease in the drive current facilitates the determination of the change point of the drive current at the time when the valve element reaches the predetermined lift position. The configuration enables to enhance the determination accuracy when the valve element reaches the predetermined lift position.

The embodiments will be described below. Hereinafter, the mutually equal or comparable parts in the embodiments are designated by the same reference numerals and are cross-referenced. The embodiments are provided as an engine control system that controls a vehicular gasoline engine.

First Embodiment

Based on FIG. 1, the description below explains a schematic configuration of the engine control system. An air cleaner 13 is provided at the uppermost stream in an intake pipe 12 of an engine 11 as a multi-cylinder internal combustion engine based on direct injection. An air flow meter 14 to detect an intake air mass is provided downstream of the air cleaner 13. A throttle valve 16 and a throttle angle sensor 17 are provided downstream of the air flow meter 14. A motor 15 adjusts an angle of the throttle valve 16. The throttle angle sensor 17 detects an angle (throttle angle) of the throttle valve 16.

A surge tank 18 is provided downstream of the throttle valve 16. The surge tank 18 is provided with an intake pipe pressure sensor 19 to detect an intake pipe pressure. The surge tank 18 connects with an intake manifold 20 to incorporate the air into each cylinder 21 of the engine 11. Each cylinder 21 of the engine 11 is provided with an electromagnetic fuel injection valve 30 that directly injects the fuel into each cylinder. An ignition plug 22 is attached to a cylinder head of the engine 11 on the basis of each cylinder 21. A spark discharge from the ignition plug 22 of each cylinder 21 ignites an air-fuel mixture in the cylinder.

An exhaust pipe 23 of the engine 11 is provided with an emission gas sensor 24 (such as an air-fuel ratio or an oxygen sensor) to detect an air-fuel ratio or a rich/lean mixture of the air-fuel mixture based on the emission gas. A catalyst 25 such as a three-way catalyst to purge the emission gas is provided downstream of the emission gas sensor 24.

A cylinder block of the engine 11 is provided with a cooling water temperature sensor 26 to detect the cooling water temperature and a knock sensor 27 to detect knocking. The outer periphery of a crankshaft 28 is provided with a crank angle sensor 29 that outputs a pulse signal each time the crankshaft 28 rotates at a predetermined crank angle. A crank angle or an engine speed is detected based on a crank angle signal from the crank angle sensor 29.

The output from various sensors is input to an ECU 40. The ECU 40 is configured as an electronic control unit mainly comprised of a microcomputer and provides the engine 11 with various controls by using detection signals from various sensors. The ECU 40 calculates the injection quantity corresponding to an engine operation state, controls the fuel injection of the fuel injection valve 30, and controls the time to ignite the ignition plug 22.

An in-vehicle battery 51 supplies the electric power to the ignition plug 22 and the fuel injection valve 30. When the battery 51 causes a decrease in voltage, an alternator 52 connected to an output shaft of the engine 11 is rotated to supply the power to the battery 51 such that the battery 51 is charged to a predetermined voltage (12 V according to the present embodiment).

Figure 2:
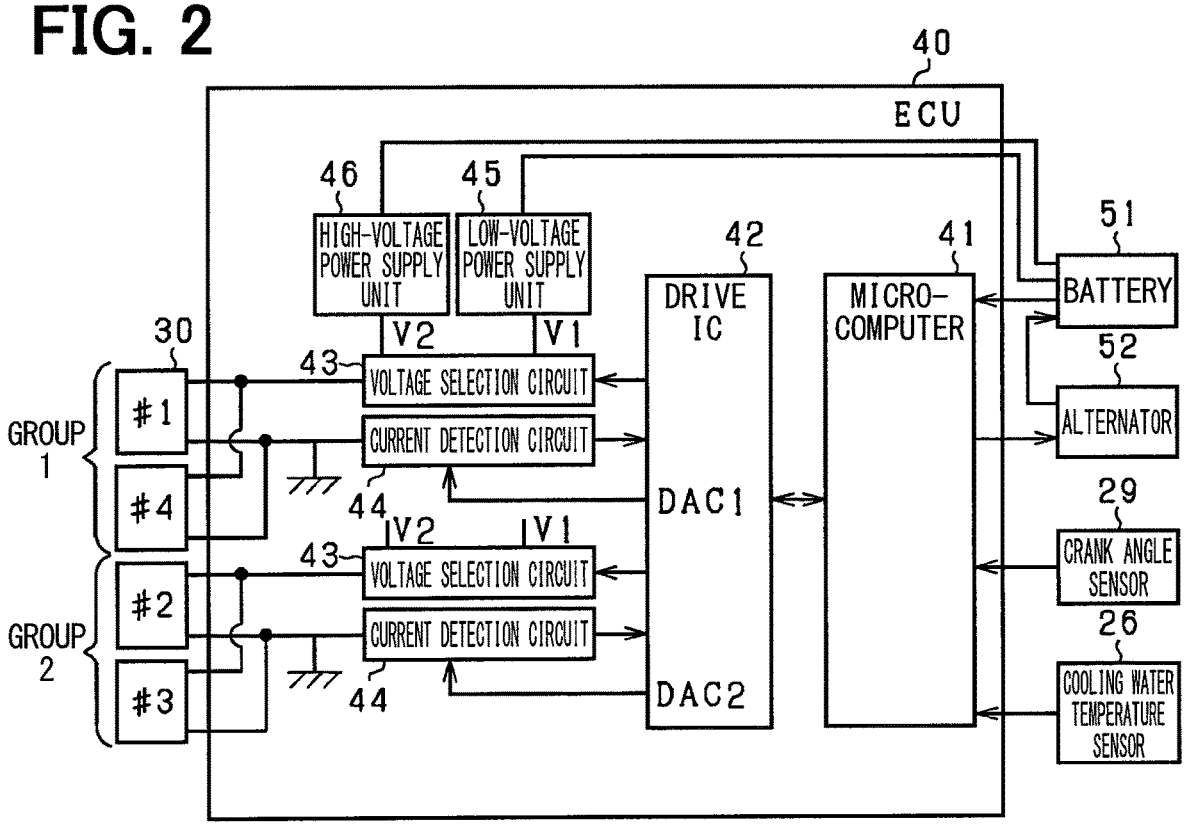
FIG. 2 is a block diagram illustrating an ECU configuration.

As illustrated in FIG. 2, the ECU 40 includes a microcomputer 41 to control the engine (a microcomputer to control the engine 11), a drive IC 42 to drive the injector (a drive IC to drive the fuel injection valve 30), a voltage selection circuit 43, and a current detection circuit 44. The ECU 40 is comparable to a "fuel injection control device." The microcomputer 41 calculates a requested injection quantity in accordance with an engine operation state (such as an engine speed or an engine load), generates an injection pulse from the injection duration calculated based on the requested injection quantity, and outputs the injection pulse to the drive IC 42. Based on the injection pulse, the drive IC 42 drives and opens the fuel injection valve 30 to inject the fuel as much as the requested injection quantity.

The voltage selection circuit 43 selects high voltage V2 or low voltage V1 as a drive voltage applied to the fuel injection valve 30 of each cylinder 21. Specifically, the voltage selection circuit 43 turns on or off an unshown switching element to supply a drive current to a coil 31 of the fuel injection valve 30 from a low-voltage power supply unit 45 or a high-voltage power supply unit 46.

The low-voltage power supply unit 45 is comparable to a "second power supply unit" and includes a low voltage output circuit that applies a battery voltage (low voltage V1) of the battery 51 to the fuel injection valve 30. The high-voltage power supply unit 46 is comparable to a "first power supply unit" and includes a high voltage output circuit (boost circuit) that applies high voltage V2 (boost voltage) to the fuel injection valve 30. In this case, high voltage V2 is generated by boosting the battery voltage to 40 V through 70 V.

When an injection pulse drives the fuel injection valve 30 to open, low voltage V1 or high voltage V2 is chronologically selected and is applied to the fuel injection valve 30. At an initial stage of opening the valve, high voltage V2 is applied to ensure the responsiveness of the fuel injection valve 30 to open. Low voltage V1 is subsequently applied to keep the fuel injection valve 30 open.

The current detection circuit 44 is comparable to a "current detection unit" and detects an energization current (drive current) when the fuel injection valve 30 is driven to open. The detection result is successively output to the drive IC 42.

The current detection circuit 44 may be configured as widely known and includes a shunt resistance and a comparator, for example.

A system according to the present embodiment includes the high-voltage power supply unit 46, the low-voltage power supply unit 45, a fuel injection valve 30, and the current detection circuit 44. The fuel injection valve 30 is driven by the power supplied from the power supply units.

The current detection circuit 44 detects a drive current for the fuel injection valve. The system is comparable to a fuel injection system.

According to the configuration in FIG. 2, the engine 11 as a four-cylinder engine includes drive groups 1 and 2 each of which includes two cylinders collected according to the order of alternate combustion. Each drive group is provided with the voltage selection circuit 43 and the current detection circuit 44. The voltage selection circuit 43 and the current detection circuit 44 for drive group 1 select the voltage and detect the current of the fuel injection valve 30 for cylinders #1 and #4. The voltage selection circuit 43 and the current detection circuit 44 for drive group 2 select the voltage and detect the current of the fuel injection valve 30 for cylinders #2 and #3. The fuel is thereby appropriately injected into each cylinder even if fuel injection periods overlap for the two cylinders whose combustion successively occurs in order because the fuel is injected during an intake stroke and a compression stroke in each cylinder.

Figure 3:
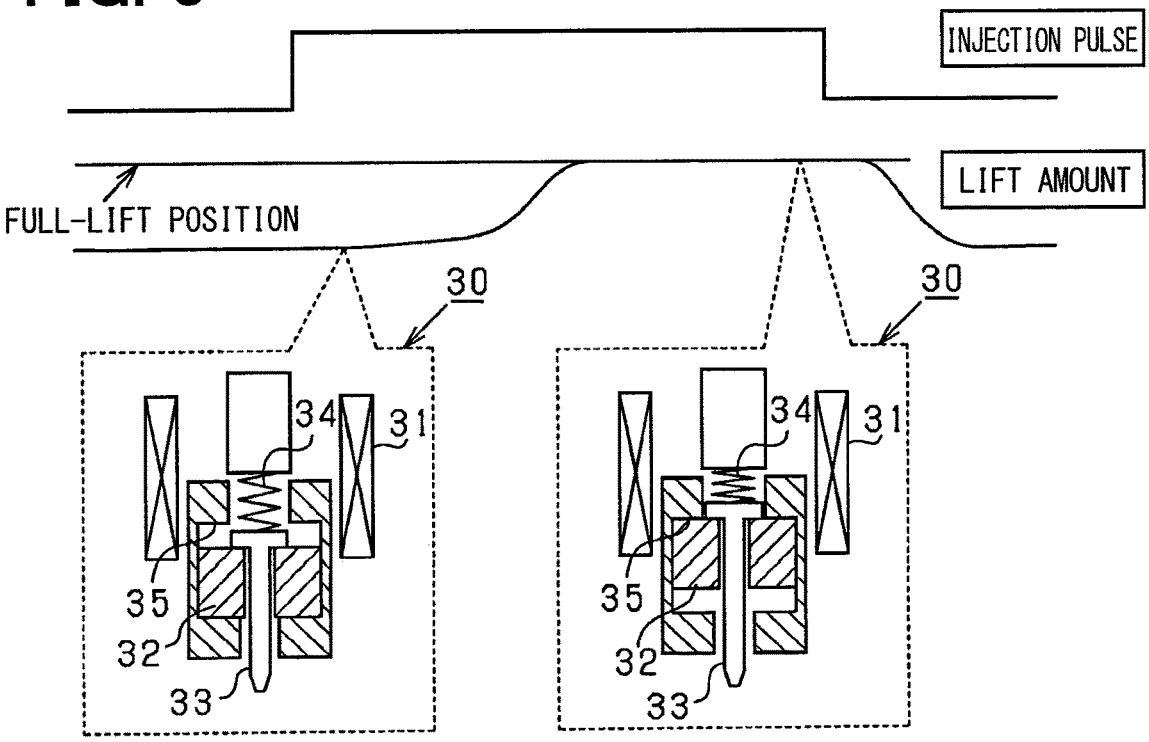
FIG. 3 is a diagram illustrating a configuration and states of a fuel injection valve.

With reference to FIG. 3, the description below explains the fuel injection valve 30. The fuel injection valve 30 includes the coil 31, a needle 33 (valve element), and a spring member 34. The coil 31 is energized to generate an electromagnetic force. The electromagnetic force drives the needle 33 along with a plunger 32 (movable core). The spring member 34 applies a force in a direction opposite the direction to close the plunger 32. The needle 33 moves to a valve-opening position against the force applied by the spring member 34. The fuel injection valve 30 is thereby opened to inject the fuel. The injection pulse falls to stop energizing the coil 31. The plunger 32 and the needle 33 return to a valve-closing position. The fuel injection valve 30 is thereby closed to stop injecting the fuel. In the following description, a "full-lift position" of the needle 33 signifies a position where the plunger 32 reaches a stopper 35 and is limited to further move in the valve-opening direction. The full-lift position is comparable to a "predetermined lift position."

Figure 4:
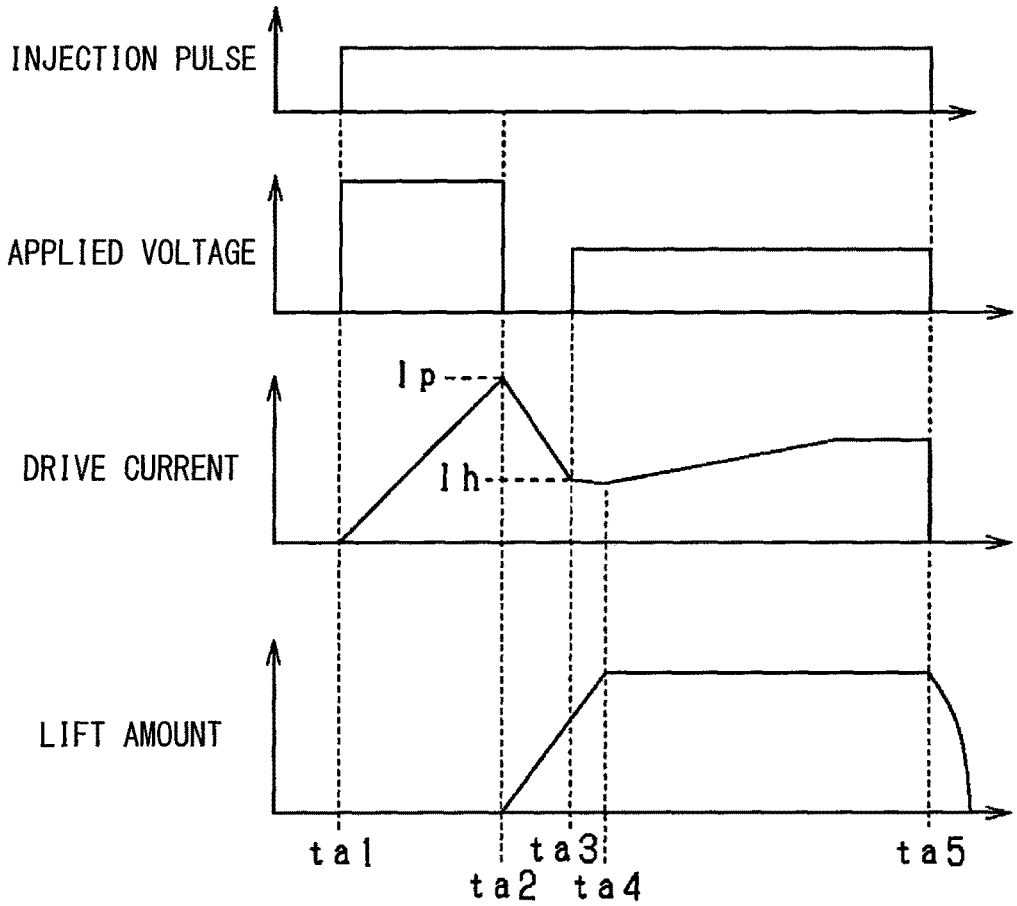
FIG. 4 is a timing chart illustrating a drive operation of the fuel injection valve.

Based on FIG. 4, the description below explains operations performed by the drive IC 42 and the voltage selection circuit 43 to drive the fuel injection valve 30.

At time ta1, the injection pulse rises to apply high voltage V2 to the fuel injection valve 30. High voltage V2 is generated by boosting the battery voltage. At time ta2, the drive current reaches predetermined peak value Ip to stop applying high voltage V2. A needle lift starts at the timing when the drive current reaches peak value Ip, or at the immediately preceding timing. The needle lift starts the fuel injection. It is determined whether the drive current reaches peak value Ip, based on the drive current detected by the current detection circuit 44. During a boost period (between ta1 and ta2), the drive IC 42 determines whether the drive current is greater than or equal to peak value Ip. When the drive current is greater than or equal to peak value Ip, the voltage selection circuit 43 selects the applied voltage (to stop applying V2).

At time ta3, the drive current goes below predetermined current threshold value Ih to apply low voltage V1 as the battery voltage to the fuel injection valve 30. It is determined whether the drive current goes below current threshold value Ih, based on the drive current detected by the current detection circuit 44. During a voltage-application stop period (between ta2 and ta3), the drive IC 42 determines whether the drive current is smaller than or equal to current threshold value Ih. When the drive current is smaller than or equal to current threshold value Ih, the voltage selection circuit 43 selects the applied voltage (to start applying V1).

After the needle 33 reaches the full-lift position, the full-lift state is maintained to continue the fuel injection. At time ta5, the injection pulse turns off to stop applying the voltage to the fuel injection valve 30. The drive current decreases to zero. Energization of the coil of the fuel injection valve 30 stops to discontinue the needle lift. The fuel injection also stops.

The fuel injection valve 30 may be subject to variations or changes in operational characteristics due to machine differences or long-term changes. Under the circumstances, the control system according to the present embodiment takes into account the above-described variations to ensure the appropriate injection quantity (to learn valve-opening characteristics). Specifically, at time ta4 between time ta3 and time ta5, the needle 33 reaches the full-lift position. The decreasing current changes to increase. A current waveform is monitored to specify the timing to complete the valve opening, namely, the timing to reach the full-lift position. The actual operation of the needle 33 is observed to correct a pulse width (a period to output the injection pulse) based on duration from the time to start outputting the injection pulse to the time to reach the full-lift position and thereby ensure the appropriate injection quantity. A process to determine the full-lift position of the needle 33 is defined as a lift position determination process.

The following is a supplemental explanation of the injection pulse width. For example, when the needle 33 reaches the full-lift position at the timing earlier than the standard timing, the needle lift is considered to occur earlier than expected or at a high lift speed due to machine differences or long-term changes in the fuel injection valve 30. The event may occur due to a decreased spring force of the spring member 34, for example. In such a case, a correction coefficient as a learning value is calculated based on the timing to reach the full-lift position. The correction coefficient is multiplied by an injection duration as the injection pulse width. When the timing to reach the full-lift position occurs earlier, a correction coefficient smaller than "1" is calculated to shorten the injection duration. When the timing to reach the full-lift position occurs later, a correction coefficient larger than "1" is calculated to lengthen the injection duration.

Figure 5:
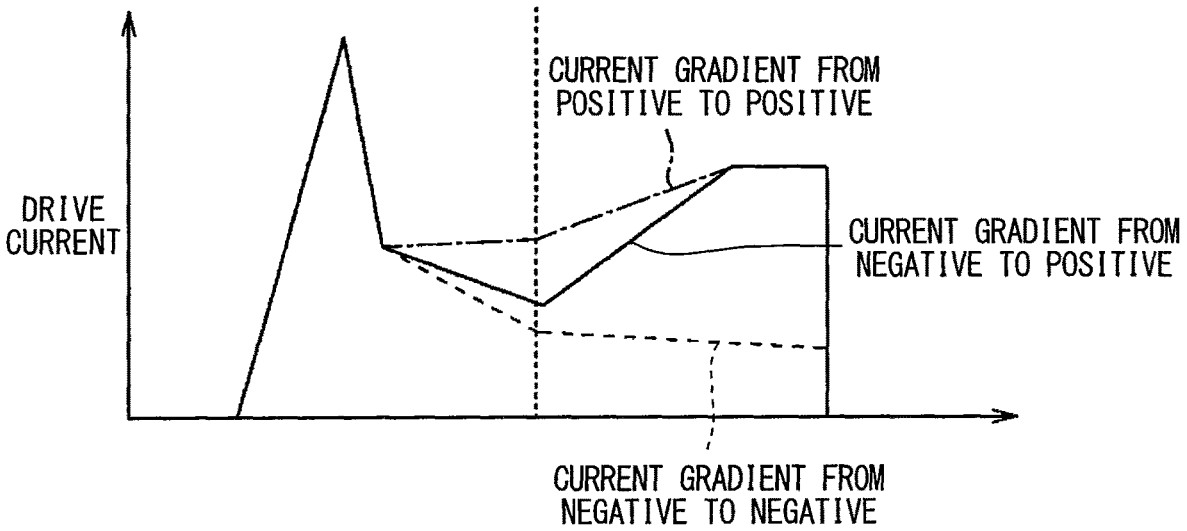
FIG. 5 is a timing chart illustrating changes in a drive current.

There may be a case where a change point for the drive current is ambiguous before and after reaching the full-lift position. For example, the drive current gradient may not reverse before and after reaching the full-lift position. Specifically, as illustrated by a broken line in FIG. 5, the drive current gradient remains negative before and after reaching the full-lift position. As illustrated by a dot-and-dash line in FIG. 5, the drive current gradient remains positive before and after reaching the full-lift position.

A solid line shows that the drive current gradient reverses from negative to positive. In this case, the reverse can be determined on condition that the drive current gradient once approximates to zero. If no reverse occurs, however, there is no distinct reference (zero or a value approximate to zero). The determination accuracy degrades and the determination cost increases.

Figure 6:
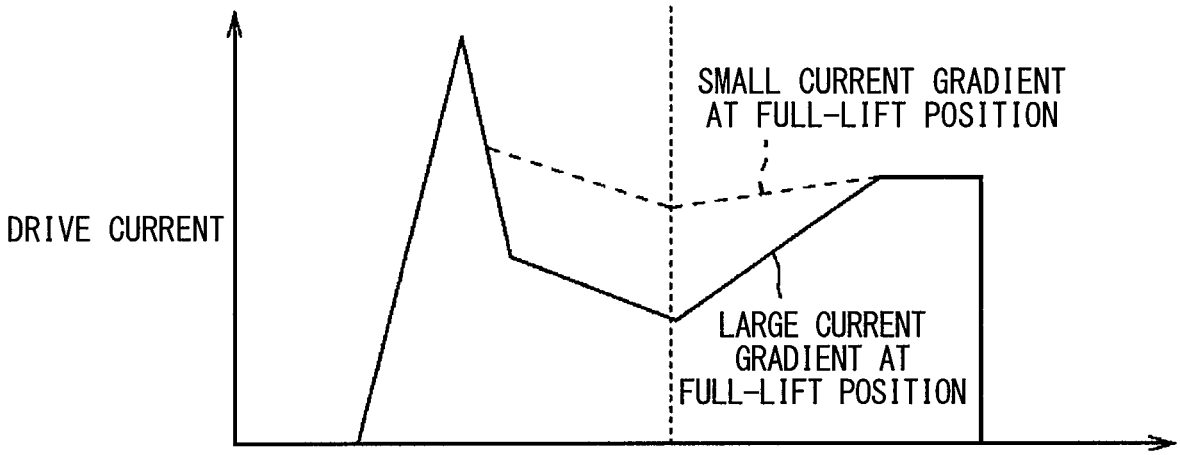
FIG. 6 is a timing chart illustrating changes in a drive current.

As illustrated in FIG. 6, the determination is difficult when the drive current gradient (positive gradient) is small after reaching the full-lift position. In this case, for example, it is difficult to distinguish a change in the drive current gradient from a noise superimposed on the drive current waveform. The determination accuracy tends to degrade.

The present embodiment controls the drive current so as to easily determine the change point for the drive current before and after reaching the full-lift position during a process (lift position determination process) to determine the full-lift position. The detailed description is as follows.

Figure 7:
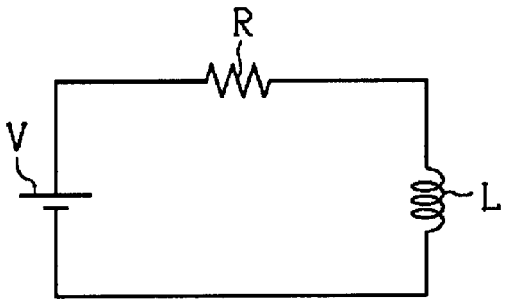
FIG. 7 is a circuit diagram of the fuel injection valve.

The description below explains the principle relating to a change in the drive current gradient before and after reaching the full-lift position. FIG. 7 schematically illustrates a circuit diagram of the fuel injection valve 30 by using applied voltage V (low voltage V1), resistance R of the coil 31, and inductance L (I/ϕ) of the coil 31. Equation (1) represents the drive current gradient before reaching the full-lift position. In the equation, "I" denotes the drive current; "dI/dt" denotes the drive current gradient; "V" denotes the voltage applied to the coil 31; "R" denotes the resistance of the coil 31; "ϕ" denotes the resistance of a magnetic flux; and "α" denotes a change (dϕ/dt) in the magnetic flux.

[Math. 1]

$$\frac{dI}{dt} = -\frac{R}{\Phi}\left(I - \frac{V-\alpha}{2R}\right)^2 + \frac{(V-\alpha)^2}{4R\Phi} \tag{1}$$

A change in the magnetic flux after reaching the full-lift position is negligible (α≈0) in comparison with the same before reaching the full-lift position. Therefore, equation (2) represents the drive current gradient after reaching the full-lift position.

[Math. 2]

$$\frac{dI}{dt} = -\frac{R}{\Phi}\left(I - \frac{V}{2R}\right)^2 + \frac{V^2}{4R\Phi} \tag{2}$$

Figure 8:
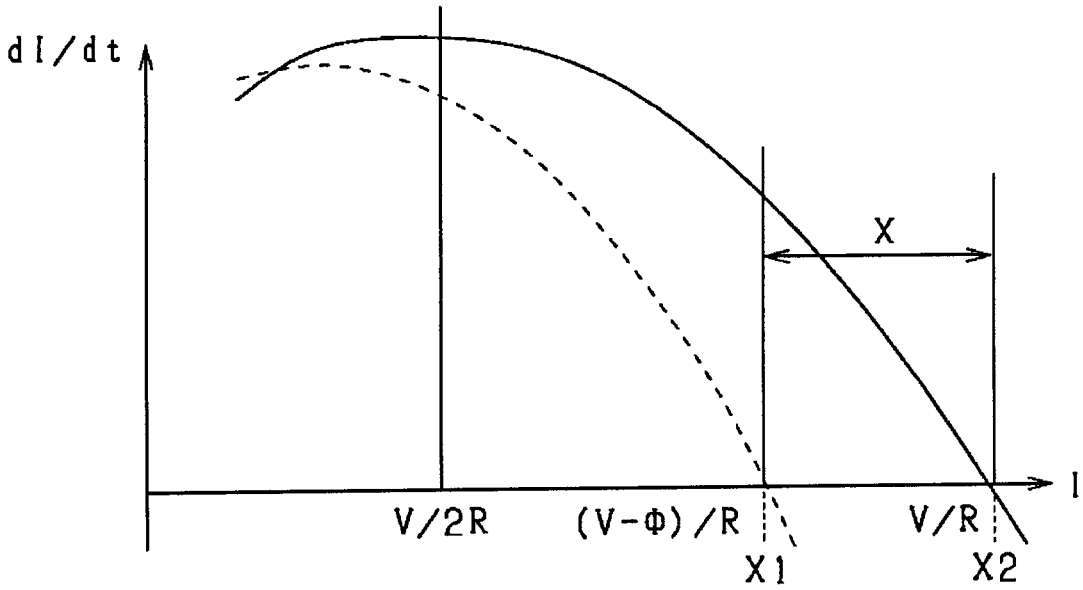
FIG. 8 is a diagram illustrating the relationship between a drive current gradient and a drive current.

FIG. 8 illustrates the relationship between drive current "I" and drive current gradient "dI/dt" specified based on equations (1) and (2). A broken line in FIG. 8 represents the relationship between the drive current gradient and drive current before reaching the full-lift position. Equation (1) specifies the relationship. A solid line in FIG. 8 represents the relationship between drive current gradient "dI/dt" and drive current "I" after reaching the full-lift position. Equation (2) specifies the relationship.

FIG. 8 illustrates that the drive current gradient reverses before and after reaching the full-lift position on condition that the drive current is observed in predetermined current range X when the full-lift position is reached. Within predetermined current range X, a decrease in the drive current increases the drive current gradient after reaching the full-lift position in a positive direction. In current range X, lower limit X1 corresponds to (V−α)/R according to equation (1) and upper limit X2 corresponds to V/R according to equation (2).

The drive current when reaching the full-lift position can be controlled to be present in predetermined current range X. The drive current gradient subsequently changes from the negative direction to the positive direction before and after reaching the full-lift position. The drive current when reaching the full-lift position can be controlled to be approximate to lower limit X1 in predetermined current range X. The drive current gradient can be subsequently increased after reaching the full-lift position.

During normal operation, the lift position determination process (to determine the full-lift position) is not executed. In this case, it is a general practice to control the drive current such that the drive current is larger than current range X or approximates to upper limit X2 in current range X. This is because, at an intermediate lift position before reaching the full-lift position, the lift amount varies with individual differences in the fuel injection valve 30 and increases individual variations in the injection quantity. During normal operation, it is advantageous to shorten the time until reaching the full-lift position and reduce the individual variations.

Normally, applied voltage V depends on a battery voltage. Resistance R and inductance L are designed such that an operation to open the fuel injection valve 30 satisfies the performance requested from the engine 11.

Figure 9:
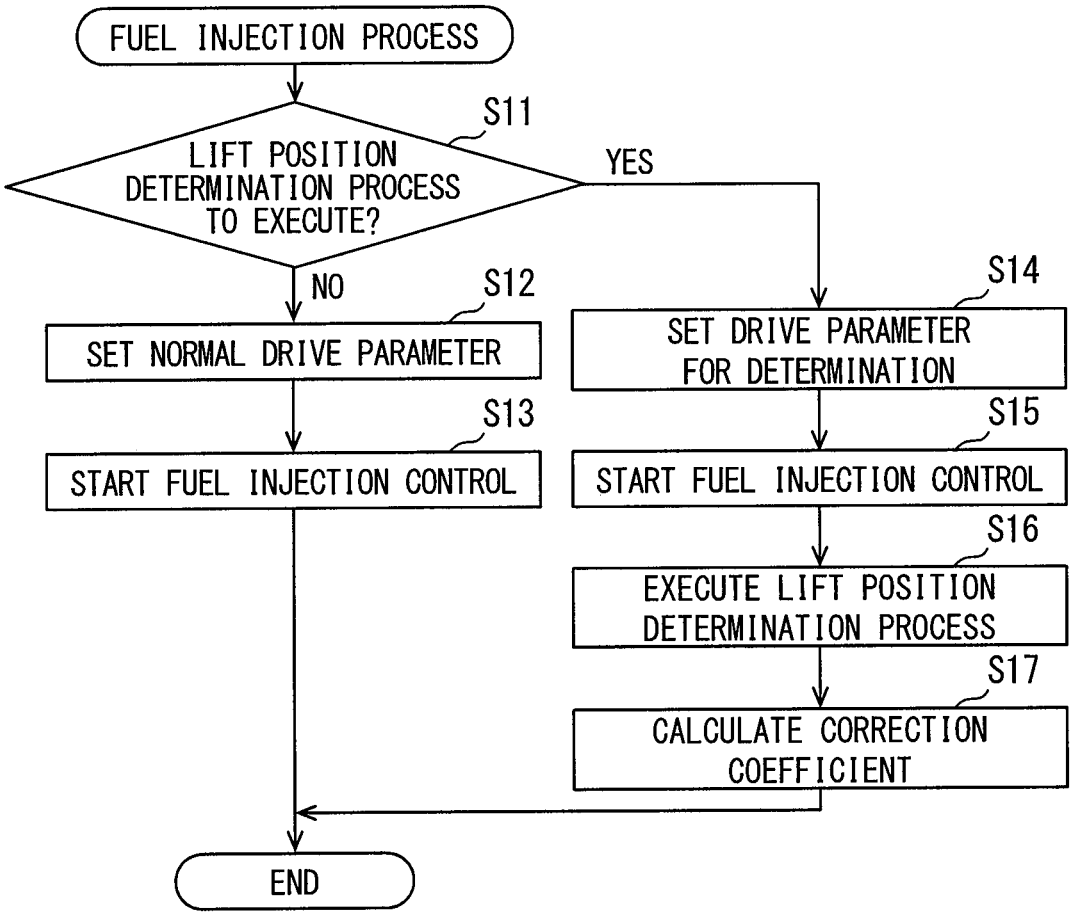
FIG. 9 is a flowchart illustrating a fuel injection process.

With reference to FIG. 9, the description below explains a fuel injection process. The ECU 40 (microcomputer 41) executes the fuel injection process. The fuel injection process is executed each time the fuel is injected. The fuel injection process is also executed when the lift position determination process is requested to be executed.

In step S11, the ECU 40 determines whether to execute the lift position determination process. Specifically, the ECU 40 determines whether the determination on the full-lift position is requested and permitted. For example, the determination on the full-lift position is requested when the engine 11 keeps the normal state (such as idling).

The determination on the full-lift position is permitted when the voltage (low voltage V1) of the battery 51 is observed within a predetermined voltage range. The predetermined voltage range signifies a voltage range that satisfies equations (3) and (4) described below. Equation (3) represents the relationship between low voltage V1 and the drive current gradient before reaching the full-lift position. Equation (4) represents the relationship between low voltage V1 and the drive current gradient after reaching the full-lift position. Equations (3) and (4) are expansions of equations (1) and (2), respectively. Drive current "I" may be set to any value within current range X such as lower limit X1. Within the voltage range, the drive current gradient follows the negative direction before reaching the full-lift position and follows the positive direction after reaching the full-lift position.

[Math. 3]

$$\frac{dI}{dt} = \frac{I}{\Phi}(V1 - RI - \alpha) < 0 \tag{3}$$

[Math. 4]

$$\frac{dI}{dt} = \frac{I}{\Phi}(V1 - RI) > 0 \tag{4}$$

If the determination result in step S11 is negative, the ECU 40 proceeds to step S12 and sets a drive parameter (normal drive parameter) used for an operation (hereinafter simply referred to as a normal operation) not executing the lift position determination process (step S16). The drive parameter according to the present embodiment includes peak value Ip and current threshold value Ih, for example. The ECU 40 proceeds to step S13, starts the fuel injection control based on the normal drive parameter set in step S12, drives the fuel injection valve 30, and terminates the fuel injection process.

In step S13, the microcomputer 41 of the ECU 40 uses a correction coefficient calculated in step S17 (described below) and reference pulse width to set an injection pulse width and outputs the injection pulse to the drive IC. The drive IC applies high voltage V2 when the injection pulse rises. The drive IC stops applying high voltage V2 when the detected drive current is larger than or equal to peak value Ip set by the microcomputer 41. Then, the drive IC starts applying low voltage V1 when the detected drive current is smaller than or equal to current threshold value Ih set by the microcomputer 41. The drive IC stops applying low voltage V1 when the injection pulse falls.

By executing the process in steps S12 and S13, the ECU 40 provides a function as a first control unit that performs drive control for the fuel injection valve 30 without executing the lift position determination process.

If the determination result in step S11 is positive, the lift position determination process is executed. The ECU 40 proceeds to step S14 and sets a drive parameter for determination so as to decrease the drive current used for the needle 33 to reach the full-lift position in comparison with the case of not executing the lift position determination process. According to the present embodiment, current threshold value Ih1 for determination included in the drive parameter for determination is smaller than normal current threshold value Ih (current threshold value Ih set in step S12). The other drive parameters such as peak value Ip are unchanged.

Consequently, the lift position determination process, if executed, delays the timing to start applying low voltage V1 in comparison with the case of not executing the lift position determination process, decreasing the drive current when reaching the full-lift position. Current threshold value Ih1 for determination may be changed as needed if the drive current when reaching the full-lift position is present within current range X. Preferably, current threshold value Ih1 for determination is small if the drive current when reaching the full-lift position is present within current range X. It is advantageous to maintain current threshold value Ih1 for determination as small as possible such that the drive current when reaching the full-lift position approximates to lower limit X1 in the current range X.

The present embodiment delays the timing to start applying low voltage V1 by configuring current threshold value Ih1 for determination to be smaller than normal current threshold value Ih. However, the drive parameter may be configured as needed if the voltage-application stop period is extended. For example, the ECU 40 may be configured to supply low voltage V1 after a lapse of predetermined voltage-application stop time from the time to stop applying high voltage V2. The drive parameter may include the voltage-application stop time. When the lift position determination process is executed, it may be advantageous to extend the voltage-application stop time included in the drive parameter for determination so as to delay the timing to start applying low voltage V1 in comparison with the case of not executing the lift position determination process.

The description of the flowchart is resumed. After the process in step S14, the ECU 40 proceeds to step S15 and starts the fuel injection control based on the drive parameter for determination set in step S14.

In step S15, the microcomputer 41 of the ECU 40 uses a correction coefficient calculated in step S17 (described below) and reference pulse width to set an injection pulse width and outputs the injection pulse to the drive IC. The drive IC applies high voltage V2 when the injection pulse rises. The drive IC stops applying high voltage V2 when the detected drive current is larger than or equal to peak value Ip set by the microcomputer 41. Then, the drive IC starts applying low voltage V1 when the detected drive current is smaller than or equal to current threshold value Ih1 for determination set by the microcomputer 41. The drive IC stops applying low voltage V1 when the injection pulse falls.

In step S16, the ECU 40 executes the lift position determination process while the fuel injection valve 30 is driven. The ECU 40 determines the full-lift position and specifies the time to reach the full-lift position based on a drive current change detected by the current detection circuit 44.

Specifically, the ECU 40 acquires (or samples) the detected drive current every predetermined time during the drive operation. It is favorable to execute a filter process on the acquired drive current to remove noise. Based on the acquired drive current, the ECU 40 specifies a current waveform of the drive current and determines a change point (namely, the time to reach the full-lift position) for the drive current. For example, the ECU 40 determines a change point for the drive current when the drive current gradient changes to the positive direction from the negative direction and the gradient in the positive direction is larger than or equal to a predetermined condition.

In step S17, based on the determination result in step S16, the ECU 40 specifies a period required from the time to start outputting an injection pulse to the time the needle 33 reaches the full-lift position. The ECU 40 calculates a correction coefficient in accordance with the specified period. The fuel injection process subsequently terminates. By executing the process in steps S14 through S16, the ECU 40 provides a function as a second control unit that performs drive control over the fuel injection valve 30 by executing the lift position determination process.

Figure 10:
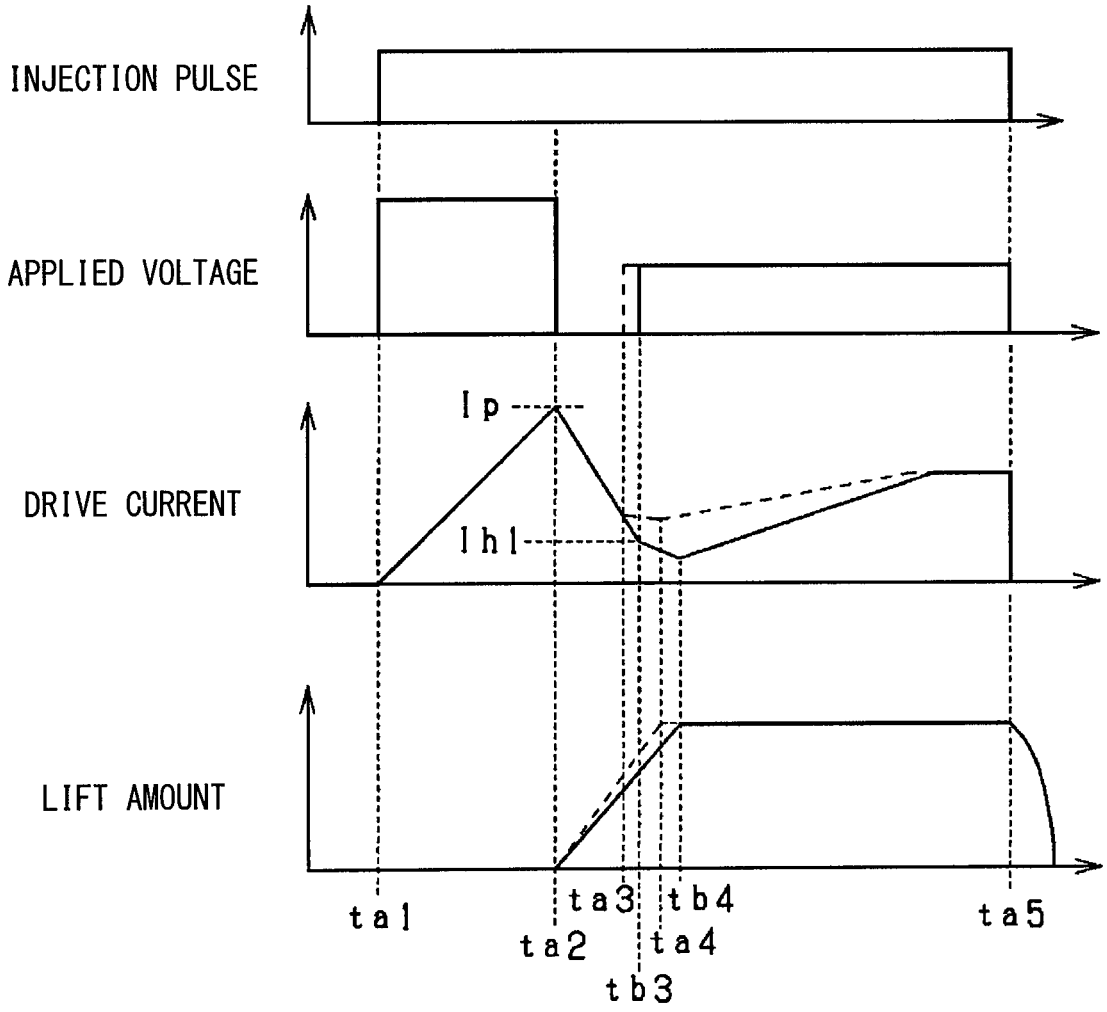
FIG. 10 is a timing chart illustrating a change in the drive current according to a first embodiment.

With reference to FIG. 10, the description below explains a difference between a drive current change in the case of not executing the lift position determination process (normal operation) and a drive current change in the case of executing the lift position determination process (to determine the full-lift position) (hereinafter referred to as a determination operation). In FIG. 10, a solid line represents a drive current change during the determination operation and a broken line represents a drive current change during the normal operation. The drive current change during the normal operation is the same as illustrated in FIG. 4 and a description is omitted. Between time ta1 and time ta3, the drive current change during the normal operation is equal to the drive current change during the determination operation.

At time tb3 after time ta3, the drive current is smaller than or equal to current threshold value Ih1 for determination. Low voltage V1 as the battery voltage is applied to the fuel injection valve 30. Current threshold value Ih1 for determination is smaller than normal current threshold value Ih. Therefore, the voltage-application stop period (between ta2 and tb3) from the time to stop applying high voltage V2 to the time to start applying low voltage V1 is longer than the normal operation. Meanwhile, the drive current continues decreasing.

After low voltage V1 is applied, the drive current slopes gently in the negative direction similarly to the normal operation. However, the drive current is small at the time to start applying low voltage V1. The drive current (at time tb4) at the change point for the drive current gradient is also small. The drive current gradient increases in the positive direction after the full-lift position is reached. The direction of sloping the drive current favorably reverses before and after reaching the full-lift position.

The direction of sloping the drive current reverses before and after reaching the full-lift position. In addition, the drive current gradient increases in the positive direction after the full-lift position is reached. The configuration enables to easily determine the change point for the drive current.

The full-lift state is maintained after the needle 33 reaches the full-lift position. The fuel injection continues. The injection pulse goes off at time ta5 to stop applying the voltage to the fuel injection valve 30. The drive current decreases to zero. The energization of the coil for the fuel injection valve 30 stops to stop lifting the needle. The fuel injection stops accordingly.

When the full-lift position is determined, it is possible to easily specify the change point for the drive current before and after reaching the full-lift position by decreasing the drive current when the full-lift position is reached.

It is favorable to increase the drive current and shorten the time required to reach the full-lift position during normal operation that does not execute the lift position determination process. This is because, at an intermediate lift position before reaching the full-lift position, the lift amount varies with individual differences in the fuel injection valve 30 and increases individual variations in the injection quantity.

In view of the foregoing, the configuration enables to provide effects as follows.

It is favorable to increase the drive current when reaching the full-lift position during normal operation that does not execute the lift position determination process in order to shorten the time required to reach the full-lift position and suppress individual variations. However, the direction of the drive current gradient does not always reverse favorably before and after reaching the full-lift position if the drive current is increased when the full-lift position is reached. The drive current gradient does not always increase in the positive direction after the full-lift position is reached. There may be a decrease in the accuracy to determine the change point for the drive current before and after reaching the full-lift position.

When executing the lift position determination process (to determine the full-lift position), the ECU 40 controls the drive current for the fuel injection valve 30 so as to decrease the drive current when the needle 33 reaches the full-lift position in comparison with the case of not executing the lift position determination process. As a result, the direction of the drive current gradient favorably reverses before and after reaching the full-lift position. The change is noticeable.

As seen from equations (1) and (2) and FIG. 8, when the drive current is present in the predetermined current range X when the full-lift position is reached, the drive current gradient reverses from the negative direction to the positive direction before and after reaching the full-lift position. The configuration enables to specify the reference (zero or a value approximate to zero) to specify the change point for the drive current. The configuration enables to increase the drive current gradient in the positive direction after reaching the full-lift position as the drive current when reaching the full-lift position is approximate to lower limit X1 in the predetermined current range X. The configuration enables to easily distinguish the drive current from a noise.

When the lift position determination process is executed, the drive current when reaching the full-lift position is decreased in comparison with the case of not executing the lift position determination process. This makes it possible to easily determine the change point for the drive current when reaching the full-lift position. The configuration enables to enhance the determination accuracy (determination accuracy) when reaching the full-lift position.

When executing the lift position determination process, the ECU 40 decreases current threshold value Ih1 for determination in comparison with the case of not executing the lift position determination process. The configuration enables to delay the timing to start applying low voltage V1 and control the drive current to decrease when the needle 33 reaches the full-lift position. The configuration enables to decrease the drive current when reaching the full-lift position without changing voltage V1 of the battery 51, resistance R of the coil 31, or inductance L.

Second Embodiment

A second embodiment differs from the first embodiment in the control and the drive parameters to start applying low voltage V1. The description below explains the second embodiment mainly in terms of differences from the first embodiment.

According to the second embodiment, the drive parameters do not include current threshold value Ih but instead include a voltage-application start time representing a time period from the start of applying high voltage V2 to the start of applying low voltage V1. The same voltage-application start time is used for the normal operation and the determination operation.

The description below explains the control to start applying low voltage V1 according to the second embodiment. In steps S13 and S15, the drive IC applies high voltage V2 when the injection pulse rises. The drive IC stops applying high voltage V2 when the detected drive current is larger than or equal to peak value Ip set by the microcomputer 41. The drive IC starts applying low voltage V1 after a lapse of the voltage-application start time set by the microcomputer 41 from the time to start applying high voltage V2. The drive IC stops applying low voltage V1 when the injection pulse falls.

Peak value Ip1 for determination is smaller than normal peak value Ip (peak value Ip set in step S12) both belonging to the drive parameters for determination set in step S14. The timing to stop applying high voltage V2 occurs earlier in the case of executing the lift position determination process than in the case of not executing the same. The time duration (voltage-application start time) elapses constantly from the time to start applying high voltage V2 to the time to start applying low voltage V1. The voltage-application stop period is longer in the case of executing the lift position determination process than in the case of not executing the same. The result is to decrease the drive current when reaching the full-lift position.

Peak value Ip1 for determination may be changed as needed if the drive current when reaching the full-lift position is present within the above-described current range X. Preferably, peak value Ip1 for determination is small if the drive current when reaching the full-lift position is present within the above-described current range X. It is advantageous to maintain peak value Ip1 for determination as small as possible such that the drive current when reaching the full-lift position approximates to lower limit X1 in the current range X.

Figure 11:
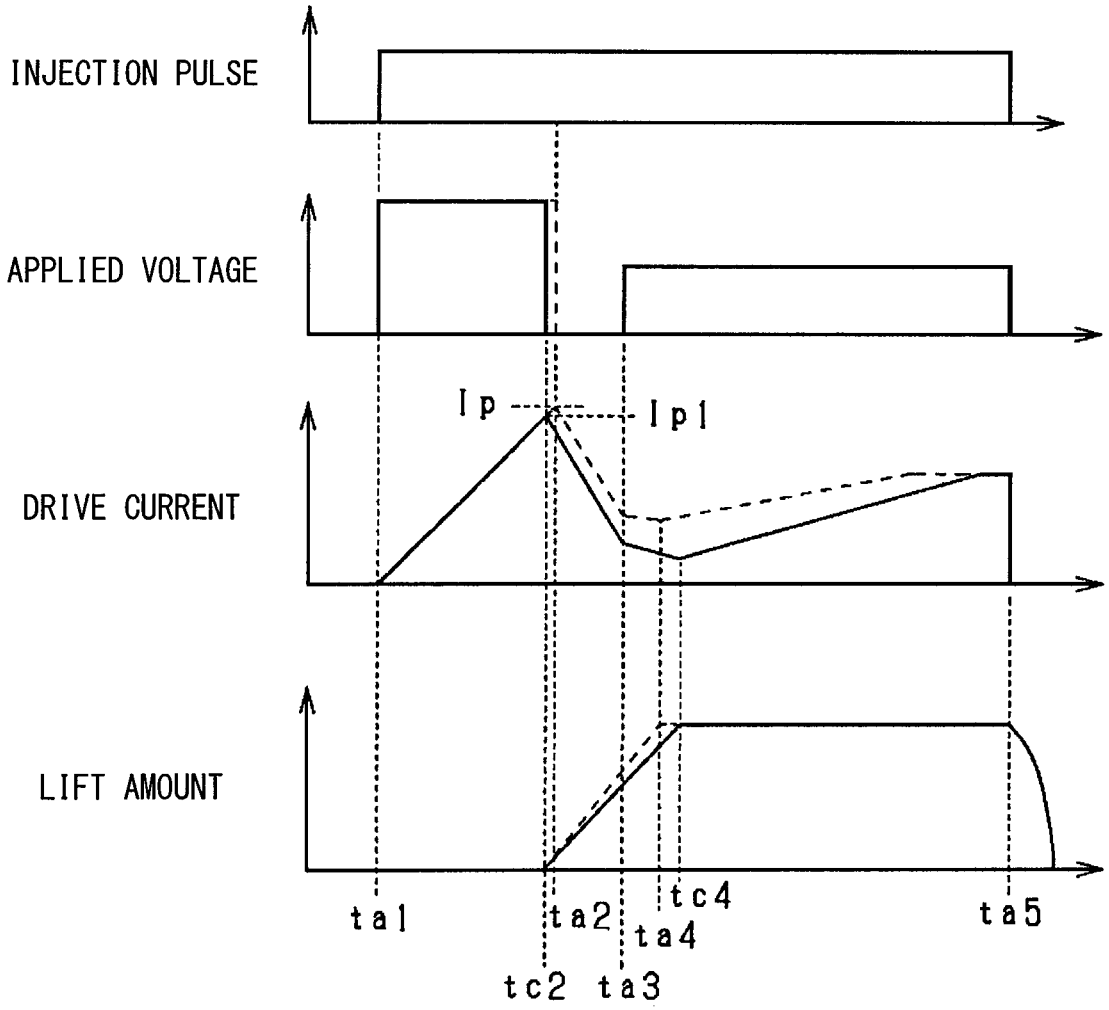
FIG. 11 is a timing chart illustrating a change in the drive current according to a second embodiment.

With reference to FIG. 11, the description below explains the difference between a drive current during the normal operation and a drive current during the determination operation. In FIG. 11, a solid line represents a drive current change during the determination operation and a broken line represents a drive current change during the normal operation. The drive current change during the normal operation is the same as above and a description is omitted.

At time ta1, the injection pulse rises to apply high voltage V2 to the fuel injection valve 30. High voltage V2 is generated by boosting the battery voltage. At time tc2, the drive current reaches peak value Ip1 for determination to stop applying high voltage V2. A needle lift subsequently starts at the timing when the drive current reaches peak value Ip1 for determination, or at the immediately preceding timing. The needle lift starts the fuel injection.

Low voltage V1 as a battery voltage is applied to the fuel injection valve 30 at time ta3 when the voltage-application start time elapses after the time to start applying high voltage V2. The timing to stop applying high voltage V2 occurs earlier. An unchanged period is ensured from the time to start applying high voltage V2 to the time to start applying low voltage V1 (from time ta1 to ta3). Therefore, the voltage-application stop period (tc2 to ta3) for the determination operation is longer than the voltage-application stop period (ta2 to ta3) for the normal operation. The drive current continues to decrease during the voltage-application stop period.

After low voltage V1 is applied, the drive current slopes gently in the negative direction similarly to the normal operation. However, peak value Ip1 is small and the voltage-application stop period is longer than that for the normal operation. Therefore, the drive current at the time to start applying low voltage V1 is smaller than the same during the normal operation. As a result, the drive current (at time tc4) at the change point for the drive current gradient during the determination operation is smaller than the same during the normal operation. The drive current gradient increases in the positive direction after the full-lift position is reached. The direction of sloping the drive current favorably reverses before and after reaching the full-lift position.

According to the above-described second embodiment, the configuration enables to provide effects as follows.

When the full-lift position determination operation is performed, peak value Ip1 for determination is set to be smaller than peak value Ip used for the case of not performing the full-lift position determination operation. The time to stop applying high voltage V2 occurs earlier in the case of executing the full-lift position determination process than the case of not executing the same.

The time duration (voltage-application start time) elapses constantly from the time to start applying high voltage V2 to the time to start applying low voltage V1 regardless of whether the lift position determination process is executed. When the full-lift position determination process is executed, the voltage-application stop period is long and peak value Ip1 for determination is small compared to the case of not executing the full-lift position determination process, thus decreasing the drive current at the time to start applying low voltage V1. Consequently, the drive current (at time tc4) at the change point for the drive current gradient is smaller than the same during the normal operation. The drive current gradient increases in the positive direction after the full-lift position is reached. The direction of sloping the drive current favorably reverses before and after reaching the full-lift position. The configuration enables to enhance the accuracy to determine the full-lift position.

Third Embodiment

A third embodiment differs from the second embodiment in the control and the drive parameters to start applying low voltage V1. The description below explains the third embodiment mainly in terms of differences from the second embodiment.

According to the second embodiment, the drive parameters do not include current threshold value Ih but instead, include the stop time representing the time duration from the time to stop applying high voltage V2 to the time to start applying low voltage V1. The same stop time is applied to the normal operation and the determination operation.

The description below explains the control to start applying low voltage V1. In steps S13 and S15, the drive IC applies high voltage V2 when the injection pulse rises. The drive IC stops applying high voltage V2 when the detected drive current is larger than or equal to peak value Ip set by the microcomputer 41. The drive IC starts applying low voltage V1 after a lapse of the stop time set by the microcomputer 41 from the time to stop applying high voltage V2. The drive IC stops applying low voltage V1 when the injection pulse falls.

Figure 12:
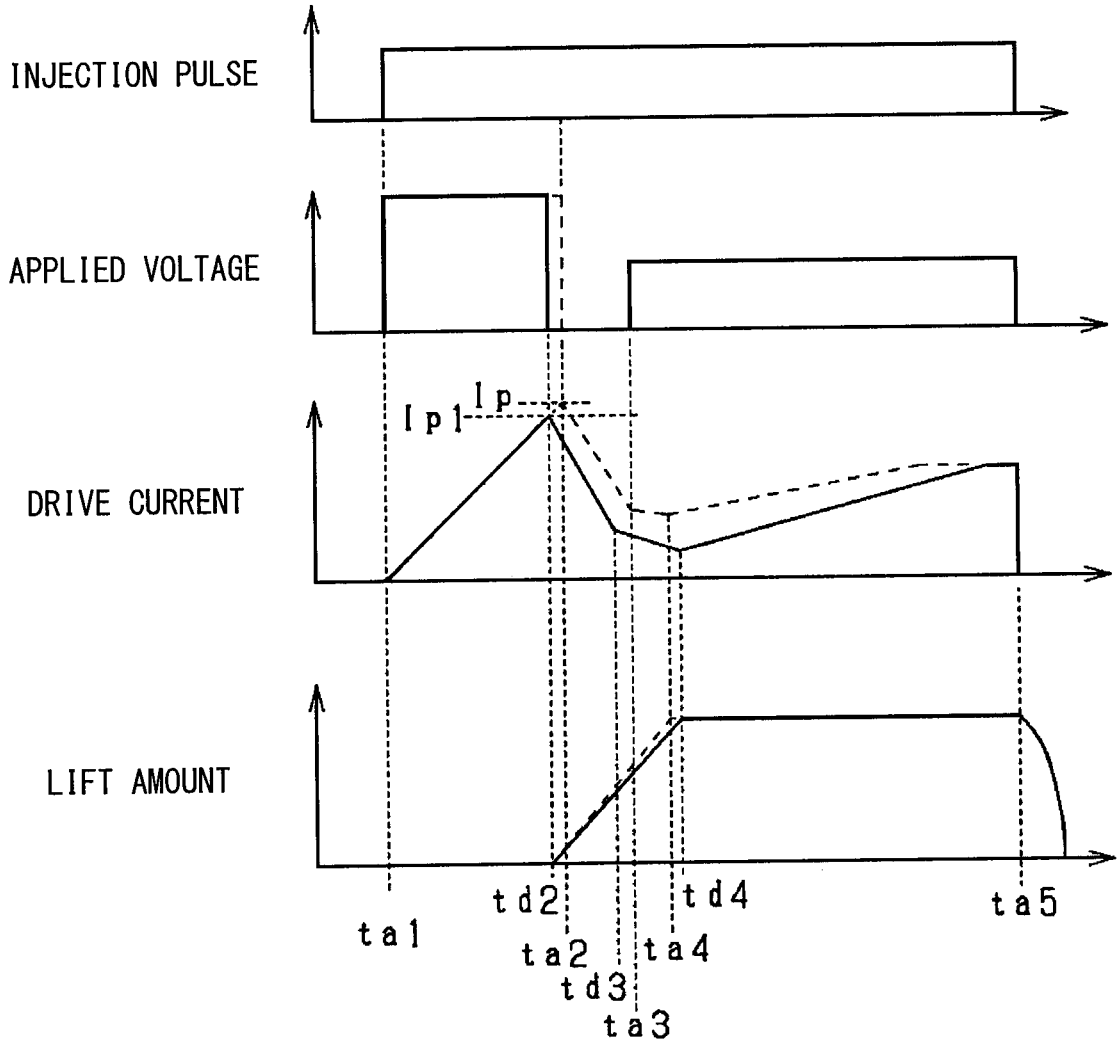
FIG. 12 is a timing chart illustrating a change in the drive current according to a third embodiment.

With reference to FIG. 12, the description below explains the difference between a drive current during the normal operation and a drive current during the determination operation. In FIG. 12, a solid line represents a drive current change during the determination operation and a broken line represents a drive current change during the normal operation. The drive current change during the normal operation is the same as above and a description is omitted.

At time ta1, the injection pulse rises to apply high voltage V2 to the fuel injection valve 30. High voltage V2 is generated by boosting the battery voltage. At time td2, the drive current reaches peak value Ip1 for determination to stop applying high voltage V2. Peak value Ip1 for the determination operation is smaller than peak value Ip for the normal operation. The timing to stop applying high voltage V2 occurs earlier. A needle lift subsequently starts at the timing when the drive current reaches peak value Ip1 for determination, or at the immediately preceding timing. The needle lift starts the fuel injection.

Low voltage V1 as a battery voltage is applied to the fuel injection valve 30 at time td3 when the stop time elapses after the time to stop applying high voltage V2. The drive current continues to decrease during the stop time.

After low voltage V1 is applied, the drive current slopes gently in the negative direction similarly to the normal operation. However, the stop time (from time td2 to td3) is equal to the normal operation (from time ta2 to ta3) and peak value Ip1 for determination is smaller than the same during the normal operation. Therefore, the drive current at the time to start applying low voltage V1 is smaller than the same during the normal operation. The result is to also decrease the drive current (at time td4) at the change point (to reach the full-lift position) for the drive current gradient. The drive current gradient increases in the positive direction after the full-lift position is reached. The direction of sloping the drive current favorably reverses before and after reaching the full-lift position.

According to the above-described third embodiment, the configuration enables to provide effects as follows.

When the full-lift position determination operation is performed, peak value Ip1 for determination is set to be smaller than peak value Ip used for the case of not performing the full-lift position determination operation. The time to stop applying high voltage V2 occurs earlier in the case of executing the full-lift position determination process than the case of not executing the same.

The stop time elapses constantly from the time to stop applying high voltage V2 to the time to start applying low voltage V1 regardless of whether the lift position determination process is executed. When the full-lift position determination process is executed, the voltage-application stop period is constant and peak value Ip1 for determination is small compared to the case of not executing the full-lift position determination process, thus causing the drive current at the time to start applying low voltage V1 to be smaller than the same during the normal operation. Consequently, the drive current (at time td4) at the change point for the drive current gradient is smaller than the same during the normal operation. The drive current gradient increases in the positive direction after the full-lift position is reached. The direction of sloping the drive current favorably reverses before and after reaching the full-lift position. The configuration enables to enhance the accuracy to determine the full-lift position.

Fourth Embodiment

A fourth embodiment mainly differs from the first embodiment in that high voltage V2 stops being applied, a reverse-polarity voltage is applied, and subsequently low voltage V1 is applied. The description below explains the fourth embodiment mainly in terms of differences from the first embodiment.

The voltage selection circuit 43 according to the fourth embodiment is configured to be able to apply high voltage V2 to the coil 31 by reversing the polarity. High voltage V2 is used as a drive voltage to be applied to the fuel injection valve 30 for each cylinder 21. According to the fourth embodiment, to apply high voltage V2 in reverse polarity is expressed as to apply flyback voltage V3, for convenience sake.

According to the present embodiment, the drive parameters do not include current threshold value Ih but instead, include the application time for flyback voltage V3. The application time for flyback voltage V3 is set to zero as the drive parameter for the normal operation. The application time for flyback voltage V3 is set to a value larger than zero as the drive parameter for the determination operation. The application time for flyback voltage V3 may be changed as needed. However, the application time for flyback voltage V3 during the determination operation is favorably longer than the application time for flyback voltage V3 during the normal operation.

The description below explains the contents of the process in step S15. In step S15, the drive IC applies high voltage V2 when the injection pulse rises. The drive IC stops applying high voltage V2 and applies flyback voltage V3 when the detected drive current is larger than or equal to peak value Ip set by the microcomputer 41.

The drive IC stops applying flyback voltage V3 when the application time set by the microcomputer 41 elapses from the time to start applying flyback voltage V3. The drive IC starts applying low voltage V1 after a lapse of specified time from the time to stop applying high voltage V2. The time duration from the time to stop applying high voltage V2 to the time to start applying low voltage V1 is set to be at least longer than the application time for flyback voltage V3. The drive IC stops applying low voltage V1 when the injection pulse falls.

The same also applies to step S13. However, step S13 differs from step S15 in that the time to apply flyback voltage V3 is short (null in the present embodiment).

Figure 13:
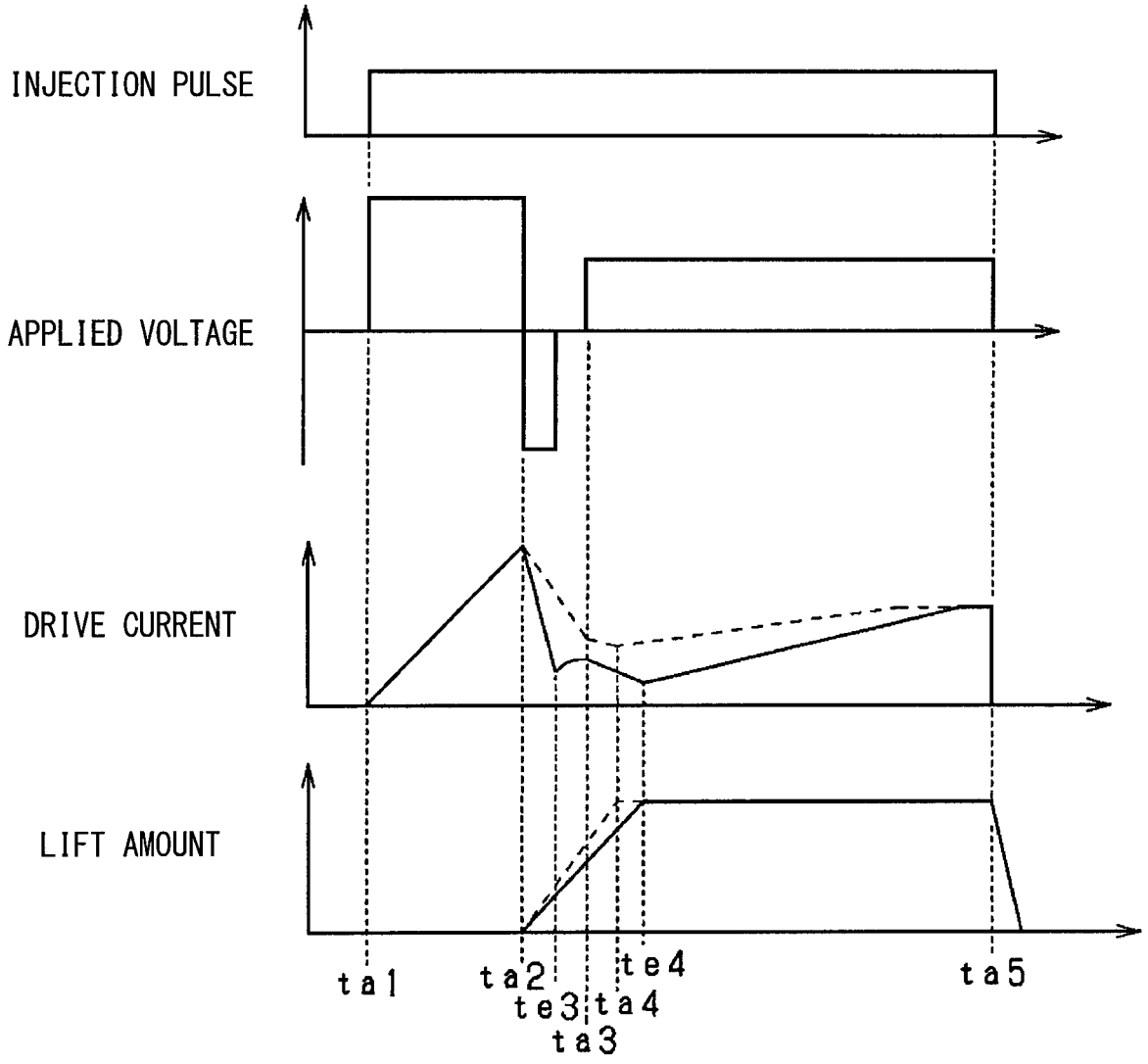
FIG. 13 is a timing chart illustrating a change in the drive current according to a fourth embodiment.

With reference to FIG. 13, the description below explains the difference between a drive current during the normal operation and a drive current during the determination operation. In FIG. 13, a solid line represents a drive current change during the determination operation and a broken line represents a drive current change during the normal operation. The drive current change during the normal operation is the same as above and a description is omitted.

At time ta1, the injection pulse rises to apply high voltage V2 to the fuel injection valve 30. High voltage V2 is generated by boosting the battery voltage. At time ta2, the drive current reaches peak value Ip to stop applying high voltage V2. A needle lift subsequently starts at the timing when the drive current reaches peak value Ip, or at the immediately preceding timing. The needle lift starts the fuel injection.

Flyback voltage V3 is applied from time ta2 to stop applying high voltage V2. Flyback voltage V3 has the polarity reverse to the polarity of high voltage V2 and low voltage V1. The drive current slopes in the negative direction more steeply in the case of executing the lift position determination process than in the case of not executing the lift position determination process.

The application time for flyback voltage V3 has elapsed at time te3 to stop applying flyback voltage V3. When the application of flyback voltage V3 stops, a back electromotive force is generated to temporarily increase the drive current.

Low voltage V1 as a battery voltage is applied to the fuel injection valve 30 at time ta4 reached after a predetermined time elapsed from the time to stop applying high voltage V2. After low voltage V1 is applied, the drive current gently decreases.

However, the drive current at the time to start applying low voltage V1 is smaller than the same during the normal operation because flyback voltage V3 is applied. As a result, the drive current (at time te4) at the change point for the drive current gradient is smaller than the same during the normal operation. The drive current gradient increases in the positive direction after the full-lift position is reached. The direction of sloping the drive current favorably reverses before and after reaching the full-lift position.

According to the above-described fourth embodiment, the configuration enables to provide effects as follows.

After the application of high voltage V2 stops, flyback voltage V3 that is reverse in polarity to high voltage V2 and low voltage V1 is applied, and subsequently low voltage V1 is applied. The ECU 40 allows the application time (application period) for flyback voltage V3 to be longer in the case of executing the lift position determination process than in the case of not executing the lift position determination process. The configuration enables to decrease the drive current at the time to start applying low voltage V1 and accordingly decrease the drive current at the change point (when the full-lift position is reached) for the drive current gradient. The drive current gradient increases in the positive direction after the full-lift position is reached. The direction of sloping the drive current favorably reverses before and after reaching the full-lift position. The configuration enables to enhance the accuracy to determine the full-lift position.

At the time to stop supplying flyback voltage V3, a back electromotive force is generated to temporarily disturb the current waveform. As a remedy, the ECU 40 determines the full-lift position after a predetermined time elapsed from the time to stop applying flyback voltage V3 and thereby enhances the determination accuracy.

Other Embodiments

The present disclosure is not limited to the above-described embodiments but may be embodied as follows. Hereinafter, the mutually corresponding or comparable parts in the embodiments are designated by the same reference numerals. The description of the parts designated by the same reference numerals is mutually applicable.

According to the above-described embodiments, the ECU 40 (microcomputer 41) includes the function as a first control unit and the function as a second control unit. The first control unit performs the drive control on the fuel injection valve 30 without executing the lift position determination process. The second control unit performs the drive control on the fuel injection valve 30 by executing the lift position determination process. Another example may provide an ECU (microcomputer) for each of the first control unit and the second control unit.

The above-described fourth embodiment may provide a power supply unit (third power supply unit) to supply flyback voltage V3 in addition to the low-voltage power supply unit 45 and the high-voltage power supply unit 46.

The above-described fourth embodiment may configure the magnitude of flyback voltage V3 to be adjustable. In this case, flyback voltage V3 during the determination operation may be higher than flyback voltage V3 during the normal operation. The time to apply flyback voltage V3 may be equal if flyback voltage V3 is increased during the determination operation.

When applying low voltage V1, the above-described embodiments may perform the duty control and may cyclically repeat an on-off operation. It is favorable to cyclically repeat the on-off operation such that the drive current falls into a specified range after reaching the full-lift position.

It is favorable to constantly apply a voltage when the lift position determination process is executed. If the configuration allows the duty control to be available, the ECU 40 may continuously apply low voltage V1 (to ensure duty ratio 100%) when the lift position determination process is executed.

In the first or fourth embodiment, the ECU 40 may allow peak value Ip during the determination operation to be smaller than peak value Ip during the normal operation. The determination operation can more promptly decrease the drive current.

The fourth embodiment may be combined with the first through third embodiments. Namely, the ECU 40 may apply flyback voltage V3 after the application of high voltage V2 stops. The determination operation can more promptly decrease the drive current.

In the fourth embodiment, the ECU 40 may stop applying flyback voltage V3 and start applying low voltage V1. Also in this case, it is favorable to reach the full-lift position after a lapse of specified time from the time to stop applying flyback voltage V3. The configuration enables to suppress the effect of the back electromotive force.

The ECU 40 according to the above-described embodiments determines the full-lift position based on a drive current gradient (differentiating the drive current once) during the lift position determination process. However, other determination methods may be used. For example, the methods include the determination based on changes in the drive current gradient (differentiating the drive current twice), the determination based on differences from a reference waveform, and the determination based on variation indexes corresponding to sample values for the drive current during a specified period.

In step S11 of the embodiments, it is needless to determine whether the determination on the full-lift position is permitted. The ECU 40 may proceed to step S14 when the determination on the full-lift position is requested.

The above-described embodiments use the correction method of calculating a correction coefficient to be multiplied by an injection duration (injection pulse width) and correcting the injection duration based on the correction coefficient. However, other correction methods may be used. For example, there may be a correction method that calculates a correction value to add or subtract the injection duration (injection pulse width) and adds or subtracts the injection duration based on the correction value. As another example, a correction method may correct the drive parameters other than the injection duration. For example, the correction may change peak value Ip, current threshold value Ih, high voltage V2, low voltage V1, the timing to stop applying high voltage V2, or the timing to start applying low voltage V1. Basically, the timing to reach the full-lift position just needs to be corrected in consideration of a difference from the reference timing.

The present disclosure has been described with reference to the embodiments but is not limited to the embodiments and structures. The present disclosure covers various modification examples and modifications within a commensurate scope. In addition, the category or the scope of the idea of the present disclosure covers various combinations or forms and moreover the other combinations or forms including only one element or more or less in the former.

The invention claimed is:

1. A fuel injection control device for a fuel injection system including a first power supply unit, a second power supply unit configured to apply a power supply voltage lower than that of the first power supply unit, a fuel injection valve configured to be driven by power supplied from each of the first power supply unit and the second power supply unit, and a current detection unit configured to detect a drive current for the fuel injection valve, the fuel injection control device configured first to cause the first power supply unit to apply a voltage to the fuel injection valve, subsequently to cause the second power supply unit to apply a voltage to the fuel injection valve, and to execute a lift position determination process after the first power supply unit applies the voltage to determine that a valve element of the fuel injection valve reaches a predetermined lift position based on a change in the drive current detected by the current detection unit, when driving the fuel injection valve, the fuel injection control device comprising:

a first control unit configured to perform a drive control on the fuel injection valve without executing the lift position determination process to perform a first fuel injection by opening the fuel injection valve and closing the fuel injection valve; and a second control unit configured to execute the lift position determination process to perform a drive control on the fuel injection valve to perform a second fuel injection by opening the fuel injection valve and closing the fuel injection vavle, wherein the second control unit is configured to, when performing the second fuel injection, control the drive current for the fuel injection valve such that the drive current when the valve element reaches the predetermined lift position decreases compared to a case where the first control unit performs the first fuel injection with the drive control; and the first fuel injection is different from the second fuel injection.

2. The fuel injection control device according to claim 1, wherein the second control unit is configured to control the drive current for the fuel injection valve to decrease within a specified current range when the valve element reaches the predetermined lift position.

3. The fuel injection control device according to claim 1, wherein the second power supply unit is configured to apply the voltage in response to decrease in the drive current for the fuel injection valve to a specified threshold value after the first power supply unit applies the voltage when driving the fuel injection valve, and the second control unit is configured to decrease the threshold value compared to a case where the first control unit performs drive control.

4. The fuel injection control device according to claim 1, wherein the second power supply unit is configured to apply the voltage in response to elapse of a specified time after the first power supply unit applies the voltage when driving the fuel injection valve, and the second control unit is configured to increase the specified time compared to a case where the first control unit performs the drive control.

5. The fuel injection control device according to claim 1, wherein the first power supply unit is configured to apply the voltage until the drive current for the fuel injection valve increases to a specified peak value, and the second power supply unit is configured to apply the voltage in response to elapse of a specified time after the first power supply unit starts applying the voltage when driving the fuel injection valve, and the second control unit is configured to decrease the peak value compared to a case where the first control unit performs the drive control.

6. The fuel injection control device according to claim 1, wherein the first power supply unit is configured to apply the voltage until the drive current for the fuel injection valve increases to a specified peak value, and the second power supply unit is configured to apply the voltage in response to elapse of a specified time after the first power supply unit stops applying the voltage when driving the fuel injection valve, and the second control unit is configured to decrease the peak value compared to a case where the first control unit performs the drive control.

7. The fuel injection control device according to claim 1, further comprising:

a third power supply unit, wherein the third power supply unit is configured to apply a voltage that is reverse in polarity to the voltage of the first power supply unit and the voltage of the second power supply unit after the first power supply unit applies the voltage and before the second power supply unit applies the voltage when driving the fuel injection valve, and the second control unit is configured to perform one of an operation to increase a period for the third power supply unit to apply the voltage and an operation to increase the voltage applied by the third power supply unit compared to a case where the first control unit performs the drive control.

8. The fuel injection control device according to claim 7, wherein the second control unit is configured to determine the predetermined lift position in response to elapse of a specified period from a time point when the third power supply unit stops applying the voltage.

9. The fuel injection control device according to claim 1, wherein the first fuel injection is performed from the opening of the fuel injection valve until the closing of the fuel injection valve, and the second fuel injection is performed from the opening of the fuel injection valve until the closing of the fuel injection valve.

10. A fuel injection control device comprising:

at least one processor configured:

to cause a first power supply unit to apply a first voltage to a fuel injection valve to perform a first fuel injection by opening the fuel injection valve and closing the fuel injection valve;

to cause a second power supply unit to apply a second voltage, which is lower than the first voltage, to the fuel injection valve to perform a second fuel injection by opening the fuel injection valve and closing the fuel injection valve, after causing the first power supply unit to apply the first voltage, such that a drive current caused in the fuel injection valve when a valve element of the fuel injection valve reaches a predetermined lift position decreases to a specified value, to detect the drive current, and to determine that the valve element reaches the predetermined lift position based on a change in the drive current; and to cause the second power supply unit to apply the second voltage to the fuel injection valve to perform the second fuel injection, after causing the first power supply unit to apply the first voltage to perform the first fuel injection such that the drive current is caused by a higher value, which is higher than the specified value, when the valve element reaches the predetermined lift position, without detecting the drive current; wherein the first fuel injection is different from the second fuel injection.

11. The fuel injection control device according to claim 10, wherein the first fuel injection is performed from the opening of the fuel injection valve until the closing of the fuel injection valve, and the second fuel injection is performed from the opening of the fuel injection valve until the closing of the fuel injection valve.

12. A method for controlling a fuel injection value including a valve element, the method comprising:

causing a first power supply unit to apply a first voltage to a fuel injection valve to perform a first fuel injection by opening the fuel injection valve and closing the fuel injection valve;

causing a second power supply unit to apply a second voltage, which is lower than the first voltage, to the fuel injection valve to perform a second fuel injection by opening the fuel injection valve and closing the fuel injection valve, after causing the first power supply unit to apply the first voltage, such that a drive current caused in the fuel injection valve when the valve element reaches a predetermined lift position decreases to a specified value, detecting the drive current, and determining that the valve element reaches the predetermined lift position based on a change in the drive current; and causing the second power supply unit to apply the second voltage to the fuel injection valve to perform the second fuel injection, after causing the first power supply unit to apply the first voltage to perform the first fuel injection such that the drive current is caused by a higher value, which is higher than the specified value, when the valve element reaches the predetermined lift position, without detecting the drive current; wherein the first fuel injection is different from the second fuel injection.

13. The method according to claim 12, wherein the first fuel injection is performed from the opening of the fuel injection valve until the closing of the fuel injection valve, and the second fuel injection is performed from the opening of the fuel injection valve until the closing of the fuel injection valve.

* * * * *